US005273000A

United States Patent [19]

Regan

[11] Patent Number: 5,273,000

[45] Date of Patent: Dec. 28, 1993

[54] REHEAT STEAM TEMPERATURE CONTROL IN A CIRCULATING FLUIDIZED BED STEAM GENERATOR

[75] Inventor: John W. Regan, West Hartford, Conn.

[73] Assignee: Combustion Engineering, Inc., Windsor, Conn.

[21] Appl. No.: 998,540

[22] Filed: Dec. 30, 1992

[51] Int. Cl.[5] ..... F22B 1/02

[52] U.S. Cl. ..... 122/4 D; 122/412; 122/483; 165/104.16; 422/146

[58] Field of Search ..... 122/4 D, 483, 412, 413; 165/104.16; 422/146

[56] References Cited

U.S. PATENT DOCUMENTS 4,111,158 8/1978 Reh et al. ..... 122/4 D
4,165,717 8/1979 Reh et al. ..... 122/4 D
4,473,032 9/1984 Maintok ..... 122/4 D
4,748,940 6/1988 Hönig ..... 122/4 D

OTHER PUBLICATIONS

Singer, Joseph G.; Combustion-Fossil Power Systems, Combustion Engineering, Inc., 1981, pp. 24–26 to 24–28.

Singer, Joseph G.; Combustion Fossil Power, Combustion Engineering, Inc., 1991, pp. 9–1 to 9–32.

*Primary Examiner*—Edward G. Favors
*Attorney, Agent, or Firm*—Chilton, Alix & Van Kirk

[57] ABSTRACT

A method of controlling the reheat steam temperature in a circulating fluidized bed combustion system wherein the circulating solids are cooled in a heat recovery fluid bed system containing reheat heat exchange surface. The rate of heat transfer and thus the reheat steam temperature are controlled by adjusting the flow rate of fluidizing air to the portion of the heat recovery fluid bed system containing the reheat surface.

4 Claims, 1 Drawing Sheet

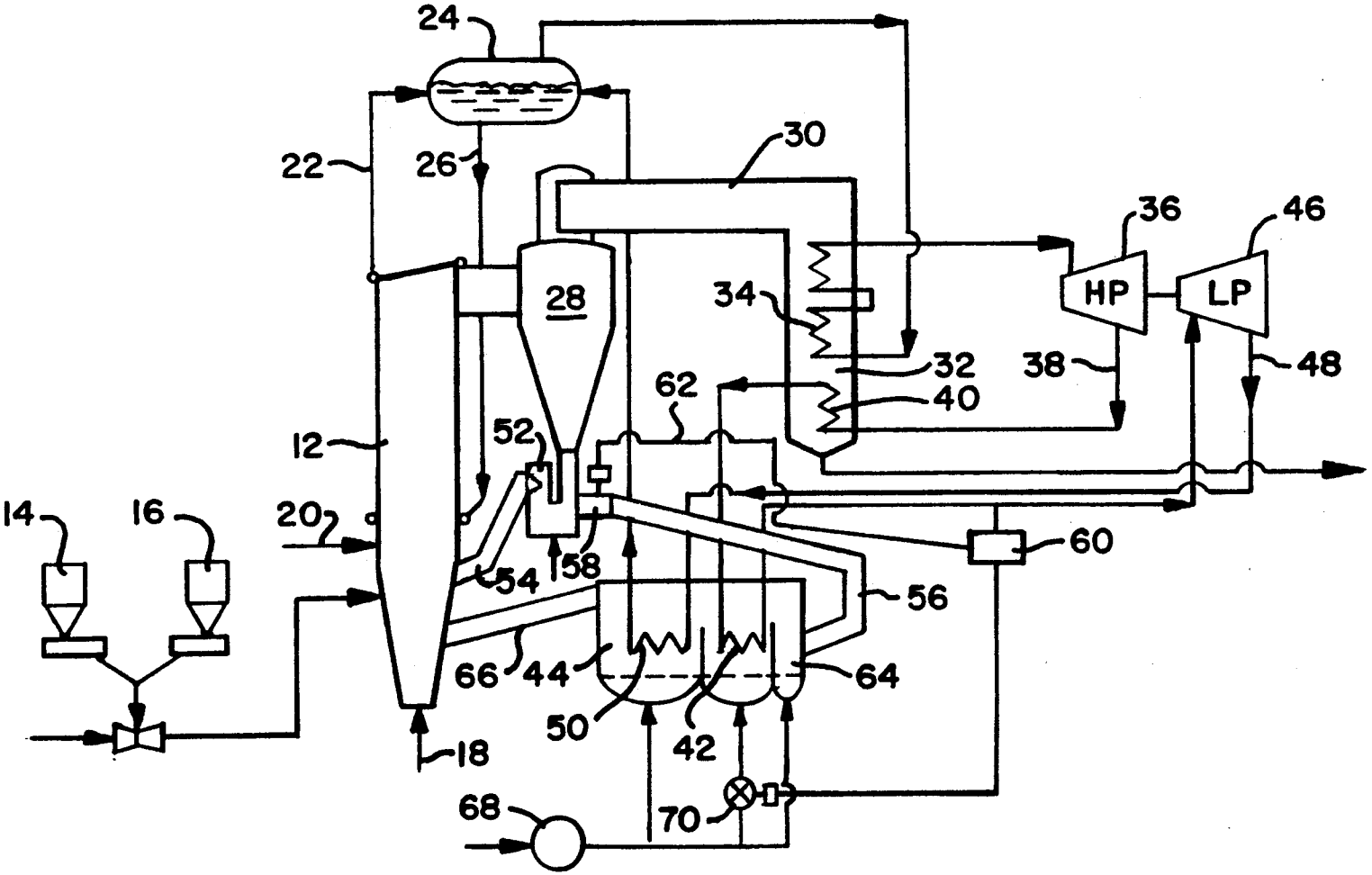
LP
HP
46
48
36
38
60
32
40
56
64
30
34
62
42
70
28
58
50
52
54
44
66
24
26
18
68
22
12
20
16
14

REHEAT STEAM TEMPERATURE CONTROL IN A CIRCULATING FLUIDIZED BED STEAM GENERATOR

BACKGROUND OF THE INVENTION

The present invention relates to a method for the fluidized bed combustion of a fuel in a circulating fluidized bed system and particularly to a method for controlling the extraction of heat from the recycle solids to control the temperature of a fluid such as reheated steam.

Fluidized bed combustion has gained favor for a number of reasons. An outstanding feature is its ability to burn high-sulfur fuels in an environmentally acceptable manner without the use of flue-gas scrubbers. In fluidized-bed combustion, much of the sulfur contained in the fuel is removed during combustion by a sorbent material in the fluid bed, usually limestone. In this process, the production of nitrogen oxides is low because of the low temperature at which the combustion reaction takes place.

One type of fluidized bed combustion is the circulating fluidized bed system. In this system, the gas velocities in the furnace are three to four times as high as in a conventional bubbling fluidized bed system. The small solid particles are carried up through the furnace and a uniform lower-density gas/solids mixture exists throughout the entire furnace. Since the solids move through the furnace at much lower velocities than the gas, significant solids residence times are obtained. The long residence time coupled with the small particle size produce high combustion efficiency and high sulfur oxide removal with lower sorbent limestone feed.

In the circulating fluidized bed combustion system, the solids which are carried from the furnace are separated from the gas by a cyclone. The solids discharged from the bottom of the cyclone pass through a seal pot or syphon seal with a portion of the solids going to a solids heat reinjected directly back into the furnace. The heat extracted from the solids in the heat recovery fluid bed system may be used to provide additional evaporation, superheat and/or reheat.

In order to prevent excessive moisture from forming in the low pressure steam turbine stages, it is conventional to interrupt the expansion process, remove the steam for reheating at constant pressure, and return it to the low pressure turbine stages. This is known as a reheat cycle. In a circulating fluidized bed system, this reheat may be performed in the convection pass of the furnace, in the heat recovery fluid bed system or a combination of these. When the heat recovery fluid bed system is used for reheat, either alone or in combination with reheat in the convection pass, a problem has been encountered in controlling the reheater steam temperature. The conventional way of controlling this reheater steam temperature is by controlling the solids flow from the bottom of the cyclone to the heat recovery fluid bed system containing the reheater. Available means for controlling such solids flow are just not accurate enough to maintain precise temperature control. It is this problem that is addressed by the present invention.

SUMMARY OF THE INVENTION

An object of the present invention is to provide a method of controlling the reheat steam temperature in a heat recovery fluid bed system. More specifically, an object is to control the recovery of heat from the recirculating solids in a circulating fluidized bed combustion systems in order to accurately control the reheat steam temperature by steps other than the mere control of solids flow. In particular, an object is to regulate the fluidizing air velocity to the reheat section of the heat recovery fluid bed system to regulate the heat transfer rate in combination with the control of the solids flow in order to accurately control the reheat steam temperature.

BRIEF DESCRIPTION OF THE DRAWING

The drawing shows an overall circulating fluidized bed combustion system including the reheat steam temperature control of the present invention.

DESCRIPTION OF THE PREFERRED EMBODIMENTS

Referring to the drawing, a typical circulating fluidized bed combustion system is illustrated beginning with the fluidized bed furnace 12. Coal and limestone are pneumatically fed to the furnace from the bins 14 and 16 respectively. The primary fluidizing air, which has been preheated, is fed to the air plenum chamber in the bottom of the furnace at 18 while secondary combustion air is fed at 20. The bottom of the furnace 12 is refractory lined to eliminate high heat losses in the primary combustion zone. The upper portion of the furnace 12 contains evaporative waterwalls. The steam generated in the waterwalls is fed via line 22 to the steam drum 24 while water is supplied to the waterwalls via line 26.

The solids carried from the furnace 12 along with the flue gas are separated from the flue gas in the cyclone separator 28. The solids are discharged from the bottom of the cyclone separator to be processed in accordance with the present invention as described hereinafter. The flue gas exits the top of the cyclone separator 28 in duct 30 and passes through the convection section 32. The flue gas would then typically be treated in a dust collector and used to preheat the incoming combustion air before being passed to the stack.

In the convection section 32 is superheating surface 34 where the steam from the steam drum 24 is superheated and passed to the high pressure turbine 36. The discharge 38 from the high pressure turbine 36 is passed to the reheater section 40 in the convection section 32 where the steam is partially reheated. From the reheater section 40, the steam is passed to the reheater section 42 in the heat recovery fluid bed system 44 to be described hereinafter. The reheated steam is then fed to the low pressure turbine 46. The discharge 48 from the low pressure turbine 46 is then passed to the economizer section 50 of the heat recovery fluid bed system 44 and returned to the steam drum 24 or other selected point in the furnace boiler circuit.

On the bottom of the cyclone separator 28 is a seal pot or syphon seal 52. This is a non-mechanical valve which moves solids collected in the cyclone separator back into the furnace 12 against the furnace pressure. Solids flow down on the inlet side, up the outlet side and then back to the furnace in duct 54. The bottom portion of this seal pot is normally fluidized so that material in the seal pot can seek different levels on each side. The difference in level corresponds to the pressure difference across the seal pot. Solids entering the inlet side then displace the solids flowing out on the outlet side.

Located in the lower portion of the seal pot 52 is a solids withdrawal pipe 56 including a solids flow control valve 58. This valve is variously referred to as a plug valve or a spiess valve and is a conventional type of valve used to control the flow of solids. This valve 58 is used for the gross adjustment of the reheat steam temperature. This is accomplished by measuring the reheat steam temperature at 60 and feeding a rough adjustment signal to the valve 58 which is indicated by the control line 62. This then controls the quantity of hot solids which are withdrawn from the seal pot 52 and introduced into the heat recovery fluid bed system 44.

The heat recovery fluid bed system 44 is a bubbling bed heat exchanger consisting of several compartments separated by weirs with the compartments containing immersed tube bundles previously referred to as reheater section 42 and economizer section 50. The hot solids enter the heat recovery fluid bed system 44 through the duct 56 where they are fluidized and transfer heat to the heat exchange surface 42 and 50. The solids initially enter the solids distribution compartment 64 and gradually pass from one compartment to the next and then out through the outlet pipe 66 and back to the furnace 12.

The fluidizing air for the heat recovery fluid bed system is supplied through line 68 and is fed to each compartment. In accordance with the present invention, the flow and velocity of the fluidizing air to the compartment containing the steam reheater surface 42 is controlled.

The rate at which heat is transferred from the solids to the steam reheater surface 42 will determine the final reheat steam temperature. For a fixed heat exchange surface and for any particular steam flow rate and solids temperature, that heat transfer rate is determined by the flow rate of solids and the fluidizing velocity of the solids in the reheater section 42. As previously indicated, the gross adjustment of reheat temperature has been made by adjusting the solids flow rate by the solids flow control valve 58. However, as also previously indicated, it is difficult to maintain an accurate reheat steam temperature by controlling the solids flow control valve 58. Therefore, in accordance with the present invention, the final control of reheat steam temperature is by controlling the fluidizing velocity of the solids in the reheater section 42. This is accomplished by controlling the fluidizing air volume and therefore its velocity through the section 42. As the volume of fluidizing air is increased, its velocity will go up and the rate of heat transfer from the solids to the reheater 42 will increase. Of course, the reverse is also true. A lower fluidizing air flow rate will decrease reheat steam temperature. As shown in the drawing, the fluidizing air is supplied by the blower 68. The rate and velocity of air flow to and through the section 42 is controlled by the reheat steam temperature measurement 60 and the air flow control valve 70. This valve 70 may be selected from known devices which accurately control gas flow.

The invention has been illustrated as including reheat exchange surface in both the convention section at 40 and in the heat recovery fluid bed system at 42. However, the invention also includes having the reheat exchange surface only in the heat recovery fluid bed system with none in the convection section. Furthermore, the invention also applies to the control of heat extraction in the heat recovery fluid bed system for streams other than the steam reheat stream.

What is claimed is:

1. A method of operating a circulating fluidized bed combustion system wherein fluidized solids from the fluidized bed furnace are separated from flue gases and at least a portion of the separated solids are cooled in a heat recovery fluid bed system having a reheater section with reheater heat exchanger by transfer of at least a portion of the heat from the solids to a reheat steam supply in said reheater heat exchanger comprising the steps of:

a. passing said reheat steam supply through said reheater heat exchanger;

b. passing said portion of said separated solids through said reheater section;

c. passing fluidizing air up through said reheater section to fluidize said solids therein and carry said solids through and out of said reheater section; and d. adjusting the amount of fluidizing air passing up through said reheater section in response to the temperature of reheated steam exiting said reheater heat exchanger.

2. A method of operating a circulating fluidized bed combustion system wherein fluidized solids from the fluidized bed furnace are separated from flue gases and at least a portion of the separated solids are cooled in a heat recovery fluid bed system having a heat exchange section containing a heat exchanger by transfer of at least a portion of the heat from the solids to a fluid in said heat exchanger comprising the steps of:

a. passing said fluid through said heat exchanger;

b. passing said portion of said separated solids through said heat exchange section;

c. passing fluidizing air up through said heat exchange section to fluidize said solids therein and carry said solids through and out of said heat exchange section; and d. adjusting the amount of fluidizing air passing up through said heat exchange section in response to the temperature of fluid exiting said heat exchanger.

3. A method as recited in claim 2 wherein said fluid is steam.

4. A method of operating a circulating fluidized bed combustion system wherein fluidized solids from the fluidized bed furnace are separated from the flue gases in a separator and wherein a first portion of the separated solids is recycled to said furnace and a second portion is fed to a heat recovery fluid bed system having a heat exchange section containing a heat exchanger for transfer of heat from the solids to a fluid in said heat exchanger comprising the steps of:

a. passing said fluid through said heat exchanger;

b. passing said second portion of said separated solids through said heat exchange section;

c. passing fluidizing air up through said heat exchange section to fluidize said solids therein and carry said solids through and out of said heat exchange section;

d. measuring the temperature of fluid exiting said heat exchanger;

e. adjusting the amount of said second portion of said separated solids to maintain said measured temperature at an approximate value; and f. adjusting the amount of fluidizing air passing up through said heat exchange section to maintain said measured temperature at a desired value.

* * * * *